US006607319B1

(12) United States Patent
Fukuda

(10) Patent No.: US 6,607,319 B1
(45) Date of Patent: Aug. 19, 2003

(54) IMAGE FORMING APPARATUS

(75) Inventor: Takehiro Fukuda, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/586,161

(22) Filed: Jun. 2, 2000

(30) Foreign Application Priority Data

Jun. 3, 1999 (JP) ..... 11-157043

(51) Int. Cl.[7] ..... B41J 3/60
(52) U.S. Cl. ..... 400/188; 400/625
(58) Field of Search ..... 400/74, 188, 625, 400/636

(56) References Cited

U.S. PATENT DOCUMENTS 5,954,436 A * 9/1999 Kageyama et al. ..... 400/188
6,266,693 B1 * 7/2001 Onaga ..... 709/219

FOREIGN PATENT DOCUMENTS

JP 62-93138 4/1987
JP 8-48447 2/1996
JP 8-133565 * 5/1996
JP 8-301513 11/1996
JP 9-110264 4/1997

OTHER PUBLICATIONS

Japanese Office Action issued Nov. 12, 2002 and English translation of relevant portions.
Japanese Office Action issued Dec. 24, 2002 and English translation of relevant portions.

* cited by examiner

*Primary Examiner*—Ren Yan
(74) *Attorney, Agent, or Firm*—Dickstein, Shapiro, Morin & Oshinsky, LLP.

(57) ABSTRACT

An image forming apparatus has a traveling unit carrying sheets of paper along a longitudinal path from a printing section to a stacker roller which guides sheets of paper having only one printed side to a stacker section. Selected sheets of paper are being displaced along a reverse path from the stacker roller back to the printing section for providing printing on the opposite side of the selected sheets, which are eventually guided by switching gates located along the reverse path to a sorting device juxtaposed with the switching gates.

24 Claims, 3 Drawing Sheets

IMAGE FORMING APPARATUS

BACKGROUND OF THE INVENTION

The present invention relates to an image formation apparatus, and in particular, to an image forming apparatus having a perfect printing paper line for carrying a sheet of paper having gone through a broadsheet printing to a printing section for the second time in order to have a reverse side of the paper printed, and a sorting device for sorting out the sheets of paper of which printing is finished.

DESCRIPTION OF THE RELATED ART

A structure of a conventional image formation apparatus of this type will be shown in FIG. 1. The image formation apparatus comprises a printing unit 30, a paper hopper 31, a perfect printing paper travelling unit 41, and a sorting device 44.

In case of conducting a broadsheet printing, a sheet of paper is carried to the printing unit 30 from the paper hopper through a paper feeding roller 32. When the printing is over, the sheet of paper is discharged along a path A to a stacker 40. In case of sorting, the sheet of paper continues along a path B, and is discharged to the sorting device 44.

In case of conducting a perfect printing, a sheet of paper having gone through a broadsheet printing travels from path A to a path C is turned over within the perfect printing paper travelling unit 41 (path D) to be carried to the printing unit 30 once again by path E and the paper carrier roller 43. As printing is executed over the reverse side, and both sides of the paper are printed, the sheet of paper will be outputted to the stacker 40 or the sorting device 44 as in the case of the broadsheet printing.

For another structure of a conventional image forming apparatus of this type, it is possible to change the position of the sorting device either to a left side or to a right side of the printing unit instead of having it at the upper side of the printing unit as shown in FIG. 1. In this way, it is possible to reduce the height of the whole image formation apparatus.

In the above-mentioned conventional image forming device, the sorting device is provided as a separate unit apart from the paper travelling line for the perfect printing. Therefore, whether it is a type having a paper travelling line for the sorting device and to be mounted on the upper side of the printing unit, or it is a type to be positioned on a side of the printing unit, the size of the apparatus as a while will become extremely large. This will result in requiring a huge set-up space.

SUMMARY OF THE INVENTION

It is therefore, an object of the present invention to provide an image forming apparatus which can maintain the whole apparatus as compact as possible even in case when the apparatus is to have both the perfect printing function and a sorting device, due to which the set-up area can be kept small.

In accordance with a first aspect of the preset invention, there is provided an image forming apparatus comprising: a perfect printing paper travelling line for carrying a sheet of paper having gone through a broadsheet printing to a printing section for the second time in order to execute a perfect printing on the sheet of paper; a sorting device for sorting the sheets of paper having gone through the broadsheet printing; and a switching gate for drawing in said sheets of paper having gone through the broadsheet printing to said sorting device, the switching gate provided in said perfect printing paper travelling line.

In accordance with a second aspect of the present invention, there is provided an image forming apparatus comprising: a perfect printing paper travelling line for carrying a sheet of paper having gone through a broadsheet printing to a printing section for the second time in order to execute a perfect printing on the sheet of paper; a sorting device for sorting the sheets of paper having gone through the broadsheet printing; and a plurality of switching gates for drawing in said sheets of paper having gone through the broadsheet printing to predetermined trays in said sorting device, the switching gates provided in said perfect printing paper travelling line.

In accordance with a third aspect of the present invention, said switching gate of the image forming apparatus comprises a solenoid and a lever operated by said solenoid.

In accordance with a fourth aspect of the present invention, the image forming apparatus further comprises a page order controlling means for firstly printing even numbered pages on one sides of the sheets of paper and then odd numbered pages on the opposite sides of the sheets of paper in case of executing a perfect printing.

In accordance with a fifth aspect of the present invention, the image forming apparatus further comprises an interface section for receiving printing data from a host device.

In accordance with a sixth aspect of the present invention, the image forming apparatus further comprises a scanner for reading a manuscript.

In accordance with a seventh aspect of the present invention, the image forming apparatus further comprises a facsimile receiving section for receiving facsimile data from a communication line.

BRIEF DESCRIPTION OF THE DRAWINGS

The above and further objects and the novel feature of the invention will more fully appear from the following detailed description when the same is read in connection with the accompanying drawings, in which.

DETAILED DESCRIPTION OF THE PREFERRED EMBODIMENT

Figure 1:
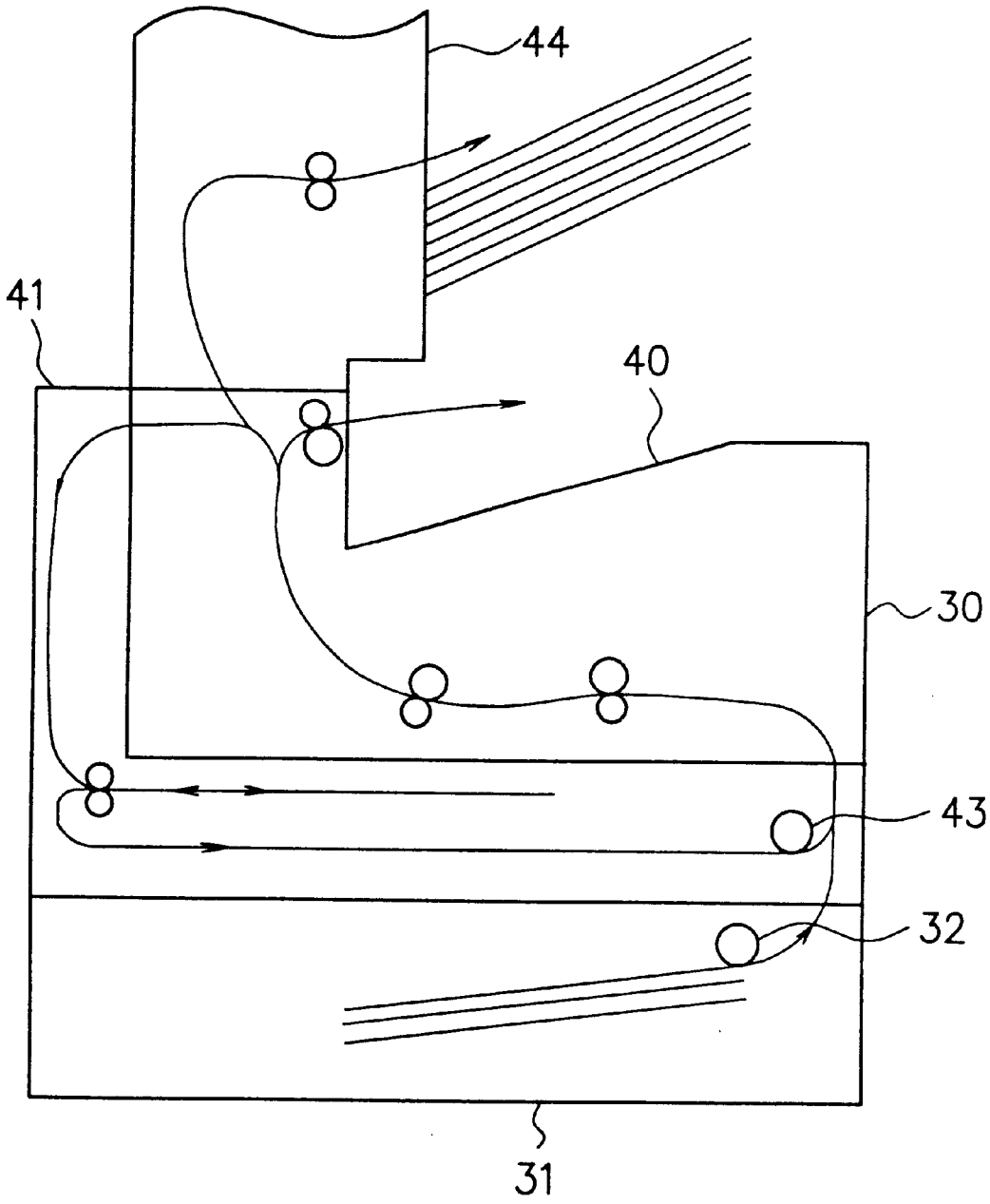
FIG. 1 PRIOR ART
FIG. 1 is a diagram showing a structure of a conventional image forming apparatus.

Referring now to the drawings, a description of a preferred embodiment of the present invention will be given in detail.

With respect to an image forming apparatus used in a printer, a copying machine, a facsimile machine, and so forth, the options for the printing technology would be an electrophotographic system, an ink jet system, a thermal printing system, a thermal system, and so on. In this particular embodiment, the explanation will be given about a laser printer using the electrophotgraphic technology.

Figure 2:
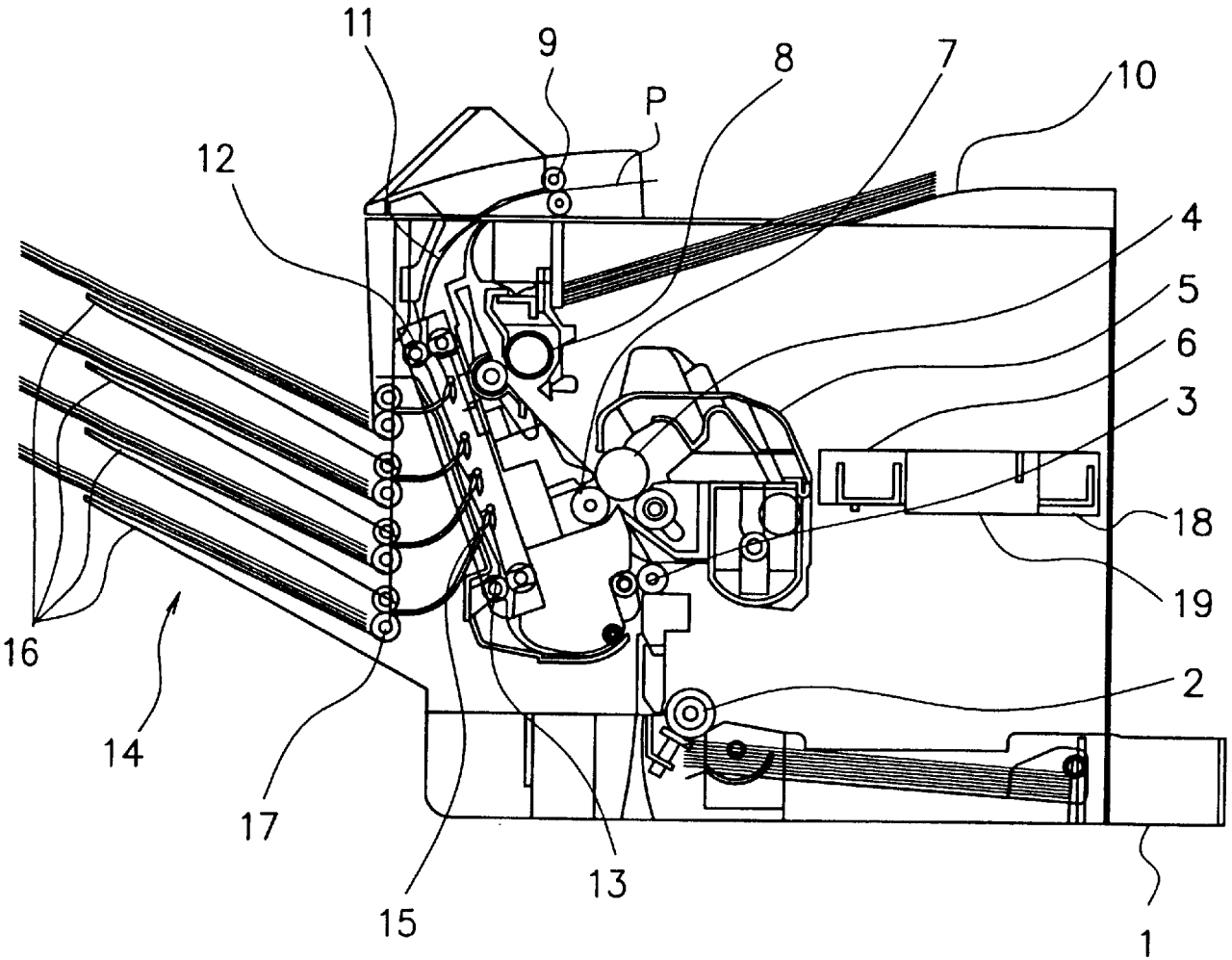
FIG. 2 is a side view showing the whole structure of an embodiment of the present invention.

FIG. 2 is a side view showing the whole structure of the embodiment of the image forming apparatus in accordance with the present invention. A stack of paper for printing is set in a paper cassette 1. A paper feeding roller 2 carries a sheet of paper to the inside of the apparatus. A resist roller 3 is used in passing over a sheet of paper carried from the paper feeding roller 2 to a photosensitive drum 4. It is used for conducting accurate printing over a predetermined position on the sheet of paper.

The photosensitive drum 4 is attached to an EP (Electrophotography) cartridge 5. A laser unit 6 scans a laser beam by a rotation mirror and form a latent image on the photosensitive drum 4. The latent image formed on the photosensitive drum 4 is developed by a developer being integrated into the EP cartridge 5. A transfer roller 7 transfers the toner image on the photosensitive drum 4 on a sheet of paper. A fixing unit 8 fixes the toner image on the sheet of paper by heat and a pressure by the upper and lower rollers.

A stacker discharge roller 9 carries the sheet of paper to the stacker 10 for discharge. In case when a perfect printing is conducted, a perfect printing paper travelling line 11 is a travelling line for carrying the sheet of paper having gone through a broadsheet printing to a photosensitive drum 4 for the second time in order to print on a reverse side of the sheet of paper. The perfect printing paper travelling line 11 is provided with a paper carrier roller 12 and a paper carrier roller 13. The perfect printing paper travelling line 11 can be a line for carrying the sheets of paper having been printed to the sorting device 14. A switching gate 15 switches the carrying between the photosensitive drum 4 and the sorting device 14. The sorting device 14 has a plurality of trays 16 and a plurality of sorter discharge rollers 17, and is further provided with a sorting function to cope with giving out multiple copies. It is also possible to let the apparatus have a mail box function in which each of the 16 trays is assigned to an individual or to a certain type of mail, on the basis of which the received mails can be sorted out.

An interface section 18 receives the printing data from a host machine. A control section 19 controls the printing process including the paper carrying.

Next the operation of the image forming apparatus of the present invention will be described. First of all, a description will be given about the case in which the sorting device 14 is not being used.

In a normal broadsheet printing, a sheet being set in the paper cassette 1 is carried to the inside of the apparatus through the paper feeding roller 2, from which it is carried to the photosensitive drum 4 through the resist roller 3. The sheet of paper having the image printed by the photosensitive drum 4 and the printing roller 7 is carried to the inside of the fixing unit 8 by the carrying force of the photosensitive drum 4 and the printing roller 7. At the fixing unit 8, the toner on the sheet of paper is fixed due to a heat and a pressure by the upper and lower rollers. The sheet of paper is then carried over to the stacker discharge roller 9 by a carrying forth of the fixing unit 8, and then discharged from the stacker discharge roller 9 to a stacker 10 placed outside the apparatus.

Here, in case of conducting a perfect printing, at the time when the sheet of paper is discharged from the stacker discharge roller 9, the stacker discharge roller 9 is reversed just before the last end of the paper completely comes off the stacker discharge roller 9, by which the sheet of paper is carried in the opposite direction. At this time, the sheet of paper proceeds to a perfect printing paper travelling line 11 as P does as shown in FIG. 2 and then carried to the resist roller 3 by the paper carrier roller 12 and the paper carrier roller 13. After that, the printing is conducted on the opposite side of the paper in the same manner as in the broadsheet printing, and the sheet of paper is discharged from the stacker discharge roller 9.

Figure 3:
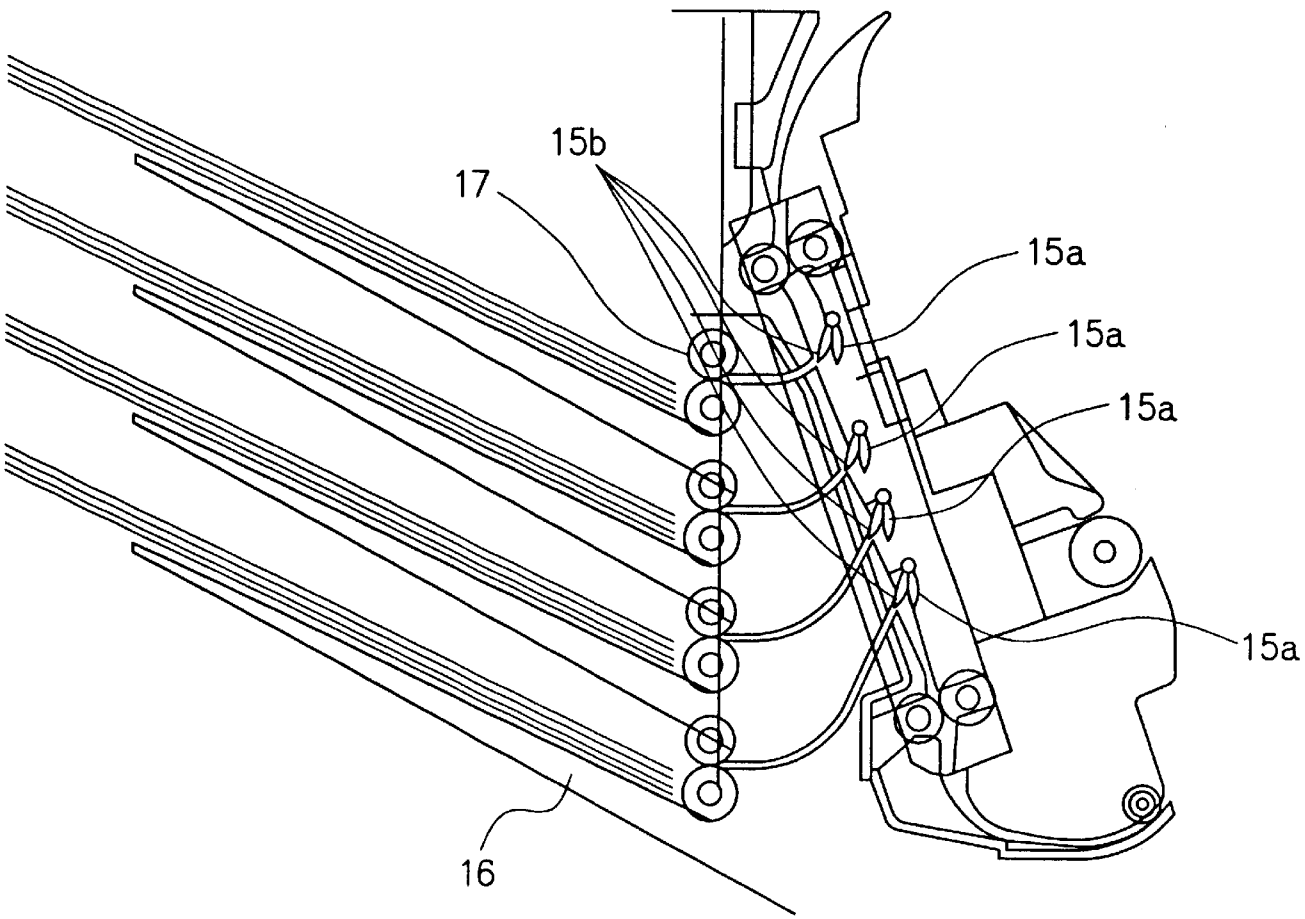
FIG. 3 is a detailed side view of a perfect printing paper travelling line and a sorting device.

FIG. 3 is a detailed side view of the perfect printing paper travelling line 11 and the sorting device 14. Now with reference to FIG. 2 and FIG. 3, a description will be given on a switching of a paper travelling direction of the perfect printing paper travelling line 11.

The sheet of paper having gone through the broadsheet printing, subjected to the printing on the opposite side is transmitted to the perfect printing paper travelling line 11, and then carried over the perfect printing paper travelling line 11 by the paper carrier roller 12. Likewise, the sheet of paper having completed with its printing and discharged to the tray 16 is transmitted to the perfect printing travelling line 11 by the stacker discharge roller 9, and then carried over the perfect printing paper travelling line 11 by the paper carrier roller 12. This process is all the same whether the sheet of paper has gone through the broadsheet printing alone or the perfect printing as well.

In the perfect printing paper travelling line 11, there are switching gates 15 for pulling in the paper into the trays 16 of the sorting device 14. With respect to the sheet of paper entering the perfect printing paper travelling line 11 which is not discharged to the tray 16, the switching gates are all posited at the side of 15*a* as shown in FIG. 3, and the paper is to be carried to the resist roller 3 within the apparatus by the carrier roller 13.

Here, when the sheet of paper is to be discharged to an arbitrary tray 16, a switching gate to the desired tray 16 alone is moved to the side of 15*b* as shown in FIG. 13 by an actuator, etc. such as a solenoid and so forth (not shown). Thus the paper travelling line is switched so that the sheet of paper is carried to the tray 16. The sheet of paper is then carried to the sorter discharge roller 17 along the switching gate 15, such that it is discharged to the desired tray 16 by the sorter discharge roller 17. This control is done by the control section 19.

The discharges from the stacker 10 and the sorting device 14 are all face-down discharges in which the printed surface is facing down. Therefore, in case of the broadsheet printing, when the printing is done from page 1, the sheets of paper are all arranged in a right order when taken out after the printing. On the other hand, in case of the perfect printing, when the printing is done from page 1, the sheets of paper are arranged such that the page order becomes "2, 1, 4, 3, . . . ", when they are taken out after the printing. In this case, the pages have to be rearranged. In order to prevent this from happening, a page order control is done in order to print the even pages first on one sides of the sheets of paper, and then print the odd page next on the other sides of the sheets of paper. This page order control is done by the control section 19. The page order control can be executed by the host device which transmits the printing data to the printer.

In the present embodiment, although the description is given only with respect to the laser printer using the electrophotographic technology, the present invention is not limited to such embodiment. It is also possible to use other printers such as an ink jet printer and so forth. It is also possible that the present invention is applied to a copying machine which executes printing of data being read out by a scanner which is provided for reading out documents. Furthermore, it is also possible that the present invention is applied to a facsimile machine which executes printing of facsimile data being received from a communication line.

As described above, in the present invention, by sharing the paper travelling line for the perfect printing as the paper travelling line directed to the trays of the sorting device, it is possible to reduce the size of the apparatus as a whole. Accordingly, the apparatus can be set requiring a little space.

While the preferred embodiment of the invention has been described using specific terms, such description is for illustrative purposes only, and it is to be understood that changes and variations may be made without departing from the spirit or the scope of the following claims.

What is claimed is:

1. An image forming apparatus comprising:

an image forming section for printing images on flat sheets of material;

a first transport mechanism that transports the printed sheets along a first travel path through the image forming section;

a discharge mechanism located at a downstream end of the first travel path operative to deliver printed sheets to a stacker;

a second transport mechanism that transports selected ones of the printed sheets along a second travel path from a point on the first travel path upstream of the stacker back to the image forming section for effecting two sided printing;

a sorting device located along the second travel path upstream of the image forming section;

a switching mechanism that cooperates with the second travel path and the sorting device to selectively divert a sheet in the second travel path to the sorting device; and a mechanism for reversing the orientation of sheets in the second travel path compared to the orientation thereof in the first travel path such that a sheet delivered to the image forming section by the first travel path has an image formed on a first side thereof, and the same sheet delivered to the image forming device on the second travel path has an image formed on a second side thereof opposite the first side, wherein the reversing mechanism comprises:

a roller located at the downstream end of the first travel path; and a drive mechanism for operating the roller in a first direction to deliver a sheet from the first travel path to the stacker and for reversing the direction of the roller prior to the sheet being delivered to the stacker to direct the sheet to the second travel path.

2. The image forming apparatus as claimed in claim 1, wherein a trailing edge of a sheet in the first travel path becomes a leading edge thereof in the second travel path.

3. An image forming apparatus comprising:

an image forming section for printing images on flat sheets of material;

a first transport mechanism that transports the printed sheets along a first travel path through the image forming section;

a discharge mechanism located at a downstream end of the first travel path operative to deliver printed sheets to a stacker;

a second transport mechanism that transports selected ones of the printed sheets along a second travel path from a point on the first travel path upstream of the stacker back to the image forming section for effecting two-sided printing;

a sorting device located along the second travel path upstream of the image forming section; and a switching mechanism that cooperates with the second travel path and the sorting device to selectively divert a sheet in the second travel path to the sorting device, wherein the discharge mechanism comprises:

a roller located at the downstream end of the first travel path; and a drive mechanism for operating the roller in a first direction to deliver a sheet from the first travel path to the stacker and for reversing the direction of the roller prior to the sheet being delivered to the stacker to direct the sheet to the second travel path, whereby the orientation of sheets in the second travel path compared to the orientation thereof in the first travel path is such that a sheet delivered to the image forming section by the first travel path has an image formed on a first side thereof, and the same sheet delivered to the image forming device on the second travel path has an image formed on a second side thereof opposite the first side.

4. The image forming apparatus as claimed in claim 3, wherein a trailing edge of a sheet in the first travel path becomes a leading edge thereof in the second travel path.

5. An image forming apparatus comprising:

an image forming section for printing images on flat sheets of material;

a first transport mechanism that transports the printed sheets along a first travel path through the image forming section;

a discharge mechanism located at a downstream end of the first travel path operative to deliver printed sheets to a stacker;

a second transport mechanism that transports selected ones of the printed sheets along a second travel path from a point on the first travel path upstream of the stacker back to the image forming section for effecting two-sided printing;

a sorting device located along the second travel path upstream of the image forming section, the sorting device comprising a plurality of sorting trays located along the second travel path upstream of the image forming section;

a switching mechanism that cooperates with the second travel path and the sorting device to selectively divert a sheet in the second travel path to a chosen one of the plurality of sorting trays;

a reversing mechanism for reversing the orientation of sheets in the second travel path compared to the orientation thereof in the first travel path such that a sheet delivered to the image forming section by the first travel path has an image formed on a first side thereof and the same sheet delivered to the image forming device on the second travel path has an image formed on a second side thereof opposite the first side, wherein the reversing mechanism comprises:

a roller located at the downstream end of the first travel path; and a drive mechanism for operating the roller in a first direction to deliver a sheet from the first travel path to the stacker, and for reversing the direction of the roller prior to the sheet being delivered to the stacker to direct the sheet to the second travel path.

6. The image forming apparatus as claimed in claim 5, wherein a trailing edge of a sheet in the first travel path becomes a leading edge thereof in the second travel path.

7. An image forming apparatus comprising:

an image forming section for printing images on flat sheets of material;

a first transport mechanism that transports the printed sheets along a first travel path through the image forming section;

a discharge mechanism located at a downstream end of the first travel path operative to deliver printed sheets to a stacker;

a second transport mechanism that transports selected ones of the printed sheets along a second travel path from a point on the first travel path upstream of the stacker back to the image forming section for effecting two-sided printing;

a sorting device located along the second travel path upstream of the image forming section, the sorting device comprising a plurality of sorting trays located along the second travel path upstream of the image forming section;

a switching mechanism that cooperates with the second travel path and the sorting device to selectively divert a sheet in the second travel path to a chosen one of the plurality of sorting trays, wherein the discharge mechanism comprises:

a roller located at the downstream end of the first travel path; and a drive mechanism for operating the roller in a first direction to deliver a sheet from the first travel path to the stacker, and for reversing the direction of the roller prior to the sheet being delivered to the stacker to direct the sheet to the second travel path, whereby the orientation of sheets in the second travel path compared to the orientation thereof in the first travel path is such that a sheet delivered to the image forming section by the first travel path has an image formed on a first side thereof and the same sheet delivered to the image forming device on the second travel path has an image formed on a second side thereof opposite the first side.

8. The image forming apparatus as claimed in claim 7, wherein a trailing edge of a sheet in the first travel path becomes a leading edge thereof in the second travel path.

9. An image forming apparatus comprising:

a first travel path having a first end and a second end;

an image forming section disposed along the first travel path and operative to print images on sheets of material;

a stacker disposed at the second end of the first travel path;

a second travel path having a first end and a second end, the second end of the second travel path intersecting with the first travel path at a location such that the sheets of material are delivered to the image forming section;

a discharge mechanism disposed at the second end of the first travel path and the first end of the second travel path, the discharge mechanism operative to:

deliver the sheets from the first travel path to the stacker; and deliver the sheets from the first travel path to the second travel path by reversing a direction of travel of the sheets;

a sorting device disposed along the second travel path; and a switching mechanism disposed along the second travel path and operative to divert the sheets from the second travel path to the sorting device.

10. The image forming apparatus as claimed in claim 9, further comprising a page order controller operative to form images of even numbered pages on first sides of selected sheets and then odd numbered pages on opposite sides of the selected sheets.

11. The image forming apparatus as claimed in claim 10, further comprising:

a data source; and an interface section operatively connecting the data source to the image forming section for receiving data therefrom.

12. The image forming device as claimed in claim 11, wherein the data source is one of a scanner and a facsimile.

13. The image forming apparatus as claimed in claim 9, further comprising:

a data source; and an interface section operatively connecting the data source to the image forming section for receiving data therefrom.

14. The image forming device as claimed in claim 13, wherein the data source is one of a scanner and a facsimile.

15. The image forming apparatus as claimed in claim 9, wherein the discharge mechanism reverses the orientation of the sheets in the second travel path compared to the orientation thereof in the first travel path such that a sheet delivered to the image forming section by the first travel path has an image formed on a first side thereof, and the same sheet delivered to the image forming device via the second travel path has an image formed on a second side thereof opposite the first side.

16. The image forming apparatus as claimed in claim 9, wherein the switching mechanism comprises a switching gate.

17. The image forming apparatus as claimed in claim 16, wherein the switching gate is comprised of a solenoid and a lever operated by the solenoid.

18. The image forming apparatus as claimed in claim 9, wherein the sorting device comprises a plurality of sorting trays located along the second travel path, and wherein the switching mechanism is operative to selectively divert a sheet in the second travel path to a chosen one of the plurality of sorting trays.

19. The image forming apparatus as claimed in claim 18, further comprising a page order controller operative to print even numbered pages on first sides of selected sheets an then odd numbered pages on opposite sides of the selected sheets.

20. The image forming apparatus as claimed in claim 18, further comprising:

a data source; and an interface section operatively connecting the data source to the image forming section for receiving data therefrom.

21. The image forming device as claimed in claim 20, wherein the data source is one of a scanner and a facsimile.

22. The image forming apparatus as claimed in claim 18, wherein the discharge mechanism reverses the orientation of the sheets in the second travel path compared to the orientation thereof in the first travel path such that a sheet delivered to the image forming section by the first travel path has an image formed on a first side thereof, and the same sheet delivered to the image forming device via the second travel path has an image formed on a second side thereof opposite the first side.

23. The image forming apparatus as claimed in claim 18, wherein the switching mechanism comprises a plurality of switching gates, each gate respectively associated with one of the plurality of sorting trays.

24. The image forming apparatus as claimed in claim 23, wherein the switching gate is comprised of a solenoid and a lever operated by the solenoid.

* * * * *